US005882697A

United States Patent [19]

Joensuu

[11] Patent Number: 5,882,697

[45] Date of Patent: Mar. 16, 1999

[54] BEARING ARRANGEMENT AND A COUPLING ELEMENT OF A SPREADING ROLL

[75] Inventor: Teuvo Joensuu, Saloinen, Finland

[73] Assignee: Raahen Tevo Oy, Saloinen, Finland

[21] Appl. No.: 973,975

[22] PCT Filed: Jun. 19, 1996

[86] PCT No.: PCT/FI96/00355

§ 371 Date: Dec. 15, 1997

§ 102(e) Date: Dec. 15, 1997

[87] PCT Pub. No.: WO97/00826

PCT Pub. Date: Jan. 9, 1997

[30] Foreign Application Priority Data

Jun. 20, 1995 [FI] Finland ..... 953052

[51] Int. Cl.[6] ..... B29C 43/46; B65H 27/00; D21G 1/02

[52] U.S. Cl. ..... 425/194; 26/102; 26/103; 226/194; 425/363

[58] Field of Search ..... 226/190, 194; 26/101, 102, 103; 425/363, 186, 193, 366, 194

[56] References Cited

U.S. PATENT DOCUMENTS

| | | | |
|---|---|---|---|
| 920,122 | 5/1909 | Farnworth | 26/102 |
| 2,712,682 | 7/1955 | Warner | 26/103 |
| 4,236,285 | 12/1980 | Gallant | 26/103 |

FOREIGN PATENT DOCUMENTS

| | | |
|---|---|---|
| 0 298 534 A1 | 1/1989 | European Pat. Off. . |
| 932061 | 5/1993 | Finland . |
| 98906 | 5/1997 | Finland . |
| 21 08 702 | 8/1972 | Germany . |
| 2 131 590 | 12/1972 | Germany . |
| 37 43 580 A1 | 7/1989 | Germany . |
| 1 340 292 | 12/1973 | United Kingdom . |
| 2 034 002 A | 5/1980 | United Kingdom . |

*Primary Examiner*—James P. Mackey

*Attorney, Agent, or Firm*—Burns, Doane, Swecker & Mathis, L.L.P.

[57] ABSTRACT

A spreading roll having a simplified and inexpensive configuration is provided. The spreading roll includes a curved shaft and several successive roll segments mounted on the curved shaft. Rolling bearings are supported by a sleeve around the shaft and rotatably support the roll segments. The ends of the roll segments are connected together by coupling elements formed by a rubber ring, an inner sleeve situated inside the ring and metal bracing sleeves situated at the corners on the outer circumference of the rubber ring. As the spreading roll rotates, the rubber rings of the coupling elements yield and the bracing sleeves form a tight joint with the roll segments.

17 Claims, 2 Drawing Sheets

BEARING ARRANGEMENT AND A COUPLING ELEMENT OF A SPREADING ROLL

BACKGROUND OF THE INVENTION

1. Field of the Invention

The invention relates to a bearing arrangement and a coupling element of a spreading roll, comprising a spreading roll and a bent shaft which is surrounded by several successive roll segments that are mounted in bearings on the shaft and that are coupled and supported endwise on each other with flexible coupling elements. The successive roll segments that are interconnected with the flexible coupling elements constitute a unit that rotates around the bent shaft. The curved spreading roll is used for spreading different kinds of materials.

2. Description of the Related Art

Successive roll segments are conventionally mounted with dual bearings, i.e. two separate bearings, around a fixed shaft. Such a construction is disclosed for example in German Patents DE-2 108 702 and DE-2 131 590. British Patents GB-2 034 002 and GB-1 340 292 disclose rolls that have been mounted with double rolling bearings and that comprise, between the roll segments, a two-part supporting bearing which simultaneously acts as a turning joint. Finnish Patent Application FI-932 060 discloses a spreading roll where bearings are positioned at the ends of the roll segments in such a way that the bearings rest on the ends of the flexible coupling elements. EP-298 534 discloses a curved roll that is mounted with dual bearings and that comprises rolling bearings positioned at a distance from the coupling elements.

The roll segments are conventionally mounted with two rolling bearings around a fixed shaft. Such a support arrangement is naturally rather rigid with respect to rotation, which has resulted in such known coupling elements in old structures where the metal halves of the coupling situated around the rubber part are entirely unconnected. In other words, the rubber part is situated between metal sleeves or the like, whereupon the metal halves of the coupling start sometimes rotating eccentrically at high speeds. This slight eccentricity produces shaking that leads to a small difference in the direction, i.e. in a slight tilt, which causes the bearings to wear mechanically and the grease of the bearings to separate, so that the oil content of the grease flows out and the remaining mere binder or the like cannot lubricate the mechanism.

SUMMARY OF THE INVENTION

The purpose of the present invention is to simplify and reduce the mounting of the roll segments in bearings on the fixed shaft. Diminishing the support provided by the bearings is enabled by the coupling element according to the invention, which has been braced with an inner ring made of metal. More accurately, the bearing arrangement and the coupling element of the spreading roll are characterized by what is disclosed in the characterizing parts of the appended claims.

The arrangement according to the invention provides considerable advantages. The structure of the spreading roll becomes simpler and the arrangement according to the invention provides almost infinite possibilities for variation. The saving in costs is also considerable. According to the conditions of use and the speed of rotation, it is possible to select a spreading roll arrangement suitable for each situation. The arrangement of bearings and coupling elements in the spreading roll according to the invention provides rotation that is more even and free of vibration compared to the prior solutions. By bracing the coupling element with the metal inner sleeve, it has been possible to simplify the structure of the coupling element.

BRIEF DESCRIPTION OF THE DRAWINGS

In the following, the invention will be described in greater detail with respect to the accompanying drawings.

DETAILED DESCRIPTION OF THE PREFERRED EMBODIMENTS

Figure 1:
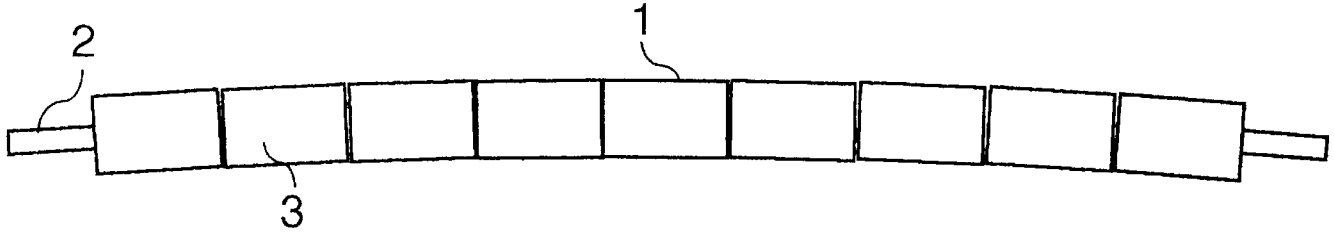
FIG. 1 shows a curved spreading roll.
Figure 2:
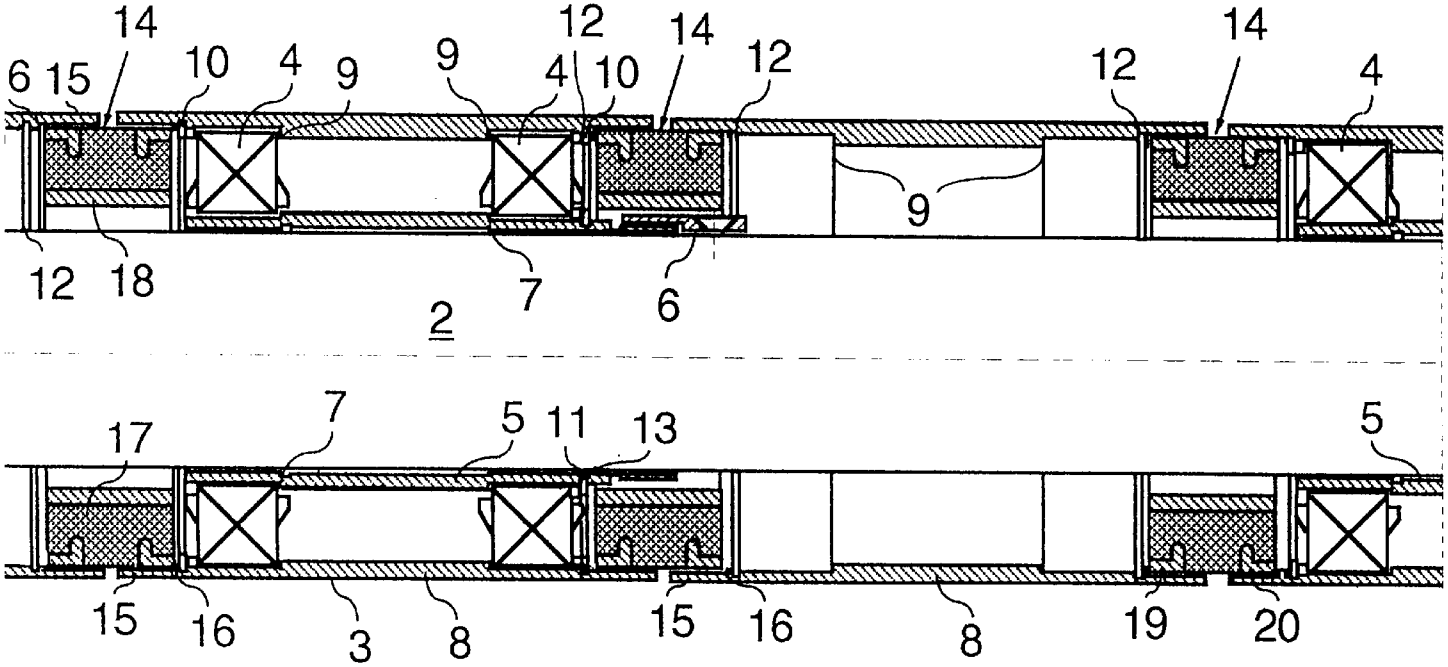
FIG. 2 is a cross-section of a spreading roll where some of the roll segments are not mounted in bearings.
Figure 3:
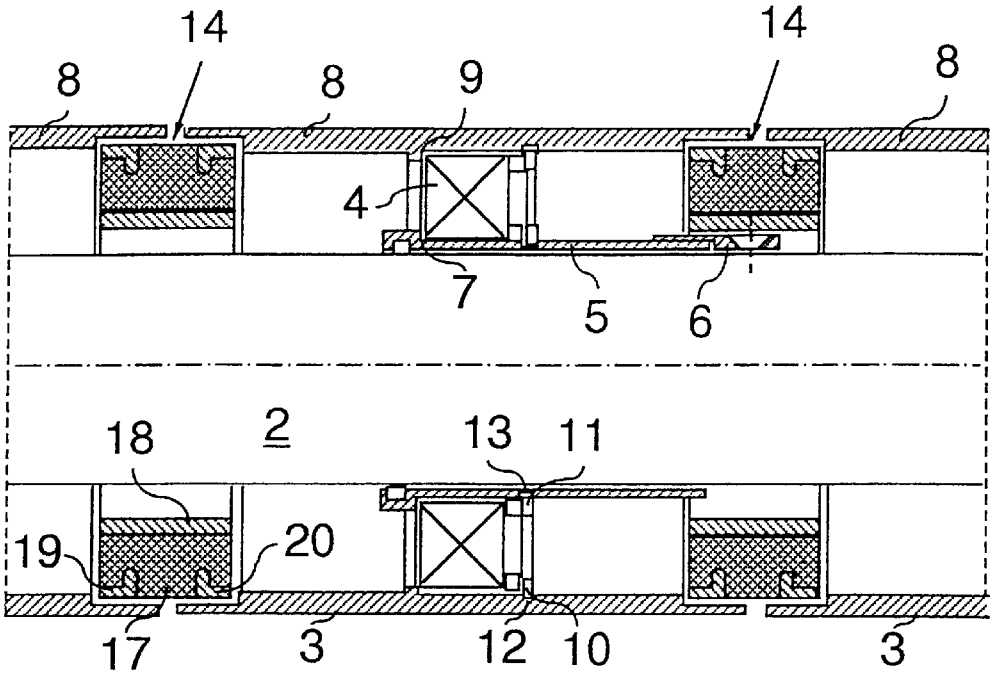
FIG. 3 is a cross-section of a spreading roll where the segments are mounted with one rolling bearing.
Figure 4:
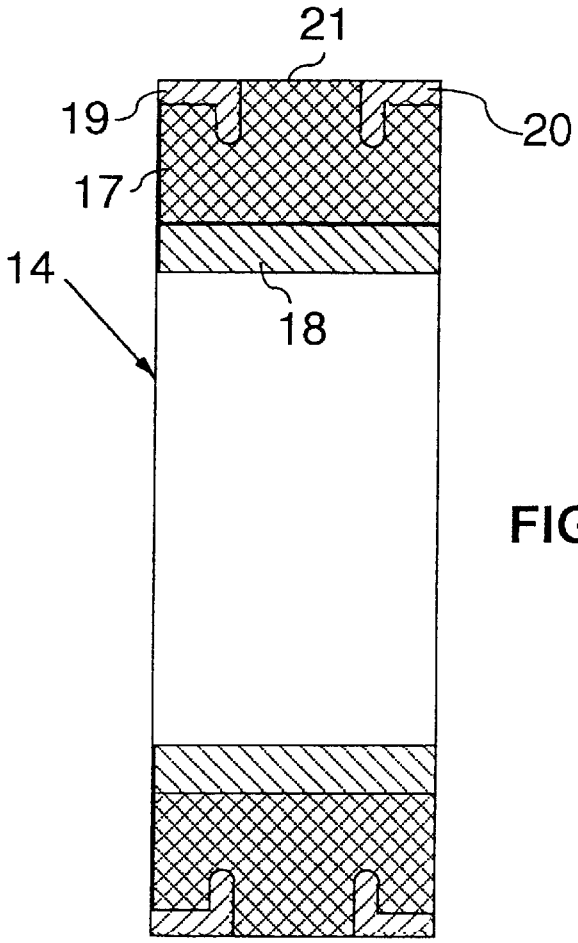
FIG. 4 is a cross-section of a coupling element.

In FIG. 1, reference numeral 1 denotes a curved spreading roll. The spreading roll 1 comprises a curved shaft 2 and several successive roll segments 3 that are placed around the curved shaft 2. In FIGS. 2 to 4, reference numeral 4 denotes rolling bearings. The bearings 4 are supported by a sleeve 5 around the shaft 2. The sleeve 5 is locked in place with respect to the shaft 2 by a locking and adjusting means 6 with which the sleeve 5 can be moved axially and the distance between the roll segments 3 can thus be adjusted correctly. The sleeve 5 comprises lugs 7 for supporting the bearings 4. The inner surface of the outer casing 8 of the roll segment 3 also comprises lugs 9 for positioning the rolling bearings 4. The rolling bearings 4 are fastened in place by means of rings 10 and 11. For the rings 10 and 11, the sleeve 5 comprises a groove 13 and the outer casing 8 comprises a groove 12. For a coupling element 14, the ends of the roll segment 3 comprise thinned sections 15 and a lug 16. The coupling element 14 is formed by a rubber ring 17, an inner sleeve 18 situated inside the ring and metal bracing sleeves 19 and 20 that are situated in the corners on the outer circumference of the rubber ring 17 and that have a cross-sectional shape of an angle iron, whereas the ends of the sleeves positioned inside the rubber are rounded. The metal bracing sleeves 19 and 20 are at the same level with the outer circumference 21 of the rubber ring 17. The sides of the coupling element 14 that are formed of the rubber ring 17, the inner sleeve 18 and the bracing sleeves 19 and 20 are straight.

The bearing arrangement and the coupling element of the spreading roll are used in the following manner. The roll segment 3 to be placed at the end of the spreading roll 1 equipped with the driving means may in principle be supported by a bearing 4 or it may comprise no bearing. The roll segments 3 can be placed one after another around the shaft 2 either with or without bearings, depending on the use and the speed of rotation. The roll segment 3 is mounted by means of rolling bearings 4. In addition to the outer casing 8 of the roll segment 3, the support arrangement also requires a sleeve 5 to which the bearings 4 are fastened by means of lugs 7 and 9, and rings 10 and 11. If the rolling bearings are not placed at the roll segment 3, the sleeve 5 is naturally not needed at all. The coupling element 14 placed at the thinned section 15 in the end of the outer casing 8 rests on the lug 16 and is supported by the bracing sleeve 19 or 20. FIG. 2 shows a construction where every other roll segment 3 comprises a double bearing arrangement with rolling bearings 4. It is naturally possible to place one rolling bearing 4 in each roll segment 3 either in close contact with the coupling elements 14 or, as shown in FIG. 3, in the middle of the roll segment 3. The number of the rolling bearings 4 naturally also depends on the length of the roll segments 3 and the thickness of the outer casing 8. The thickness and rigidity of the inner sleeve 18 of the coupling element 14 also affect the number of the bearings to some extent. A sufficient space is left between the inner sleeve 18 of the coupling element 14 and the shaft 2 for rotation and for possible angular changes. As the spreading roll rotates, the rubber ring of the coupling element 14 yields and the bracing sleeves 19 and 20 provided in the corners press in all positions effectively on the inner circumference of the thinned section 15 and form a tight joint as the spreading roll rotates.

It is clear for a person skilled in the art that the scope of the invention covers a plurality of applications by means of which the best arrangement can be found for all circumstances. It is also self-evident that the coupling element 14 can be braced from one side for example in such a way that one of the bracing sleeves 19 and 20 extends as an integral part to the inner sleeve 18, so that one side of the coupling element 14 is formed by a solid metal surface. Such a procedure provides additional support for a roll segment 3 which entirely lacks bearings 4. The places of the bearings 4 can also be selected rather freely according to the circumstances, as described above. The type of the bearings 4 can naturally vary rather widely according to known bearing mechanisms.

I claim:

1. A bearing arrangement and a coupling element of a spreading roll, comprising:

a spreading roll, a bent shaft, one or more successive roll segments mounted in bearings and coupled and supported endwise on each other with flexible coupling elements, and one or more bearings in the one or more roll segments;

wherein the flexible coupling elements include a flexible ring made of resilient material an interior of which ring comprises a rigid metal inner sleeve and an outer circumference of which is provided with metal outer sleeves positioned at corners of the ring.

2. A bearing arrangement and a coupling element of a spreading roll according to claim 1, wherein an outer circumference of the outer sleeves placed on the outer circumference of the rubber ring is at the same level as said rubber ring.

3. A bearing arrangement and a coupling element of a spreading roll according to claim 1, wherein the outer sleeves have a cross-sectional shape of an angle iron where one arm is rounded and placed inside the rubber ring.

4. A bearing arrangement and a coupling element of a spreading roll according to claim 1, wherein the coupling element, the inner sleeve, the rubber ring and the outer sleeves form a ring with straight sides.

5. A bearing arrangement and a coupling element of a spreading roll according to claim 1, wherein an inner diameter of the inner sleeve is greater than an outer diameter of the shaft and allows a change in an angle between the flexible coupling element and the shaft.

6. A bearing arrangement and a coupling element of a spreading roll according to claim 1, wherein an outer circumference of the flexible coupling element is placed tightly inside thinned ends of an outer casing of the roll segments, and that lugs of said thinned ends keep the coupling elements in place.

7. A bearing arrangement and a coupling element of a spreading roll according to claim 1, wherein the bearing of the roll segment are positioned in lugs provided in an outer casing and in lugs of a sleeve situated around the shaft, and that said sleeve is fastened to the shaft with a locking and adjusting means.

8. A bearing arrangement and a coupling element of a spreading roll according to claim 1, wherein at least one of the roll segments includes an outer casing which rests solely on the flexible coupling elements.

9. A bearing arrangement and a coupling element of a spreading roll according to claim 1, wherein each roll segment comprises one or more bearings.

10. A bearing arrangement and a coupling element of a spreading roll according to claim 7, wherein a distance between the roll segments can be adjusted by the locking and adjusting means which fastens the roll segments to the shaft.

11. A bearing arrangement and a coupling element of a spreading roll according to claim 1, wherein there are one or more roll segments without bearings.

12. A spreading roll comprising:

a bent shaft;

a plurality of roll segments mounted end to end on the shaft;

a plurality of bearings rotatably supporting the plurality of roll segments on the shaft; and a plurality of flexible coupling elements connecting the plurality of roll segments, the coupling elements each including a flexible ring, a rigid inner sleeve at an inner circumference of the flexible ring, and at least one rigid outer sleeve at an outer circumference of the flexible ring.

13. The spreading roll according to claim 12, wherein each of the plurality of roll segments is rotatably supported by one of the plurality of bearings.

14. The spreading roll according to claim 12, wherein each of the plurality of roll segments is rotatably supported by two of the plurality of bearings.

15. The spreading roll according to claim 12, wherein the flexible ring is formed of rubber and the rigid inner and outer sleeves are formed of metal.

16. The spreading roll according to claim 12, wherein the flexible coupling elements each include two rigid outer sleeves positioned at opposite ends of the flexible ring.

17. The spreading roll according to claim 12, wherein there are one or more roll segments without bearings.

* * * * *